US005488286A

United States Patent [19]

Rozman et al.

[11] Patent Number: 5,488,286

[45] Date of Patent: Jan. 30, 1996

[54] METHOD AND APPARATUS FOR STARTING A SYNCHRONOUS MACHINE

[75] Inventors: Gregory I. Rozman, Rockford; Albert L. Markunas, Roscoe; Michael J. Hanson, Loves Park; Leland E. Weber, Rockford, all of Ill.

[73] Assignee: Sundstrand Corporation, Rockford, Ill.

[21] Appl. No.: 61,497

[22] Filed: May 12, 1993

[51] Int. Cl.[6] ..... F02N 11/04

[52] U.S. Cl. ..... 322/10; 322/11; 290/46

[58] Field of Search ..... 322/10, 13; 310/156; 290/31, 46; 318/254

[56] References Cited

U.S. PATENT DOCUMENTS

| | | | |
|---|---|---|---|
| 3,775,974 | 12/1973 | Silver | 60/39.34 |
| 3,902,073 | 8/1975 | Lafuze | 290/46 |
| 3,908,161 | 9/1975 | Messenger | 322/29 |
| 4,093,869 | 6/1978 | Hoffman et al. | 290/31 |
| 4,295,085 | 10/1981 | Lafuze | 318/721 |
| 4,354,126 | 10/1982 | Yates | 310/156 |
| 4,456,830 | 6/1984 | Cronin | 290/27 |
| 4,473,752 | 9/1984 | Cronin | 290/38 R |
| 4,684,081 | 8/1987 | Cronin | 244/58 |
| 4,687,961 | 8/1987 | Horber | 310/186 |
| 4,694,210 | 9/1987 | Elliott et al. | 310/68 R |
| 4,708,030 | 11/1987 | Cordner | 74/686 |
| 4,743,777 | 5/1988 | Shilling et al. | 290/46 |
| 4,772,802 | 9/1988 | Glennon et al. | 290/31 |
| 4,808,903 | 2/1989 | Matsui et al. | 318/800 |
| 4,841,216 | 6/1989 | Okada et al. | 322/10 |
| 4,868,406 | 9/1989 | Glennon et al. | 290/4 R |
| 4,900,231 | 2/1990 | Kennedy | 417/16 |
| 4,933,623 | 6/1990 | Fox | 322/25 |
| 4,935,686 | 6/1990 | Stacey | 318/801 |
| 4,939,441 | 7/1990 | Dhyanchand | 318/718 |
| 4,942,493 | 7/1990 | Rozman et al. | 361/23 |
| 4,947,100 | 8/1990 | Dhyanchand et al. | 322/10 |
| 4,949,021 | 8/1990 | Rozman et al. | 318/254 |
| 4,959,595 | 9/1990 | Nishimura | 318/138 |
| 4,967,334 | 10/1990 | Cook et al. | 363/34 |
| 4,968,926 | 11/1990 | Dhyanchand | 322/10 |
| 4,988,939 | 1/1991 | Reichard et al. | 318/800 |
| 4,992,721 | 2/1991 | Latos | 322/10 |
| 5,008,801 | 4/1991 | Glennon | 363/132 |
| 5,012,177 | 4/1991 | Dhyanchand et al. | 322/10 |
| 5,013,929 | 5/1991 | Dhyanchand | 290/31 |
| 5,015,927 | 5/1991 | Reichard | 318/139 |
| 5,015,941 | 5/1991 | Dhyanchand | 322/10 |
| 5,028,803 | 7/1991 | Reynolds | 290/31 |
| 5,040,366 | 8/1991 | Schulze | 60/39.08 |
| 5,051,670 | 9/1991 | De Piola | 318/434 |
| 5,055,700 | 10/1991 | Dhyanchand | 290/31 |
| 5,055,764 | 10/1991 | Rozman et al. | 322/10 |

(List continued on next page.)

FOREIGN PATENT DOCUMENTS 2206751 1/1989 United Kingdom .

OTHER PUBLICATIONS

E. Iizuka, et al., *IEEE Transactions on Industry Applications,* vol. a–21, No. 4, May/Jun. 1985.

Furuhashi, et al., *IEEE Transactions on Industrial Electronics,* vol. 39, No. 2, Apr. 1992.

A. E. Fitzgerald, et al., *Electric Machinery,* 246–249, 270–271.

*Primary Examiner*—Steven L. Stephan
*Assistant Examiner*—Nicholas Ponomarenko
*Attorney, Agent, or Firm*—Marshall, O'Toole, Gerstein, Murray & Borun

[57] ABSTRACT

A synchronous machine is operable in a starting mode of operation in which a magnitude of a parameter of power applied to a main generator portion armature winding of the synchronous machine is detected relative to a stationary frame of reference and is converted into field and torque producing components relative to a rotating frame of reference. A controllable power source coupled to the main generator portion armature winding is controlled during operation in the starting mode based upon the field and torque producing components.

11 Claims, 2 Drawing Sheets

U.S. PATENT DOCUMENTS

| | | | |
|---|---|---|---|
| 5,068,590 | 11/1991 | Glennon et al. | 322/10 |
| 5,079,494 | 1/1992 | Reichard | 318/811 |
| 5,097,195 | 3/1992 | Raad et al. | 322/10 |
| 5,113,125 | 5/1992 | Stacey | 318/721 |
| 5,132,604 | 7/1992 | Shimane et al. | 322/10 |
| 5,140,245 | 8/1992 | Stacey | 318/723 |
| 5,198,733 | 3/1993 | Wright | 318/254 |
| 5,202,613 | 4/1993 | Kruse | 318/254 |
| 5,221,881 | 6/1993 | Cameron | 318/254 |
| 5,233,275 | 8/1993 | Danino | 318/254 |
| 5,309,081 | 5/1994 | Shah et al. | 322/10 |

FIG. 1A
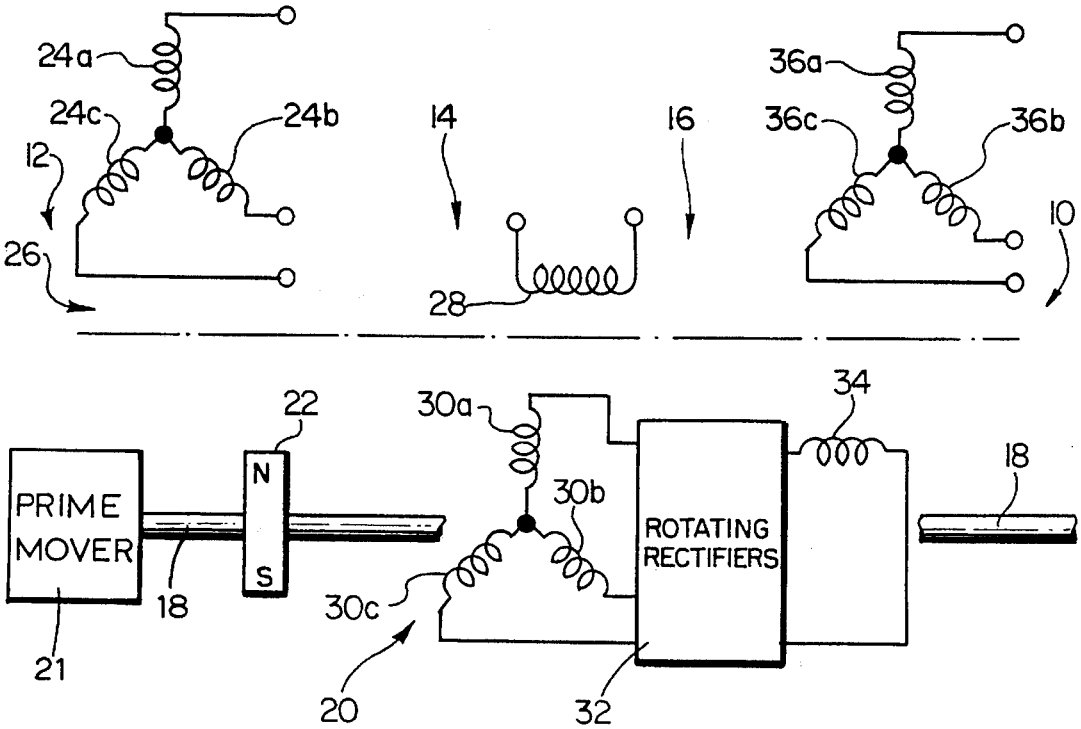
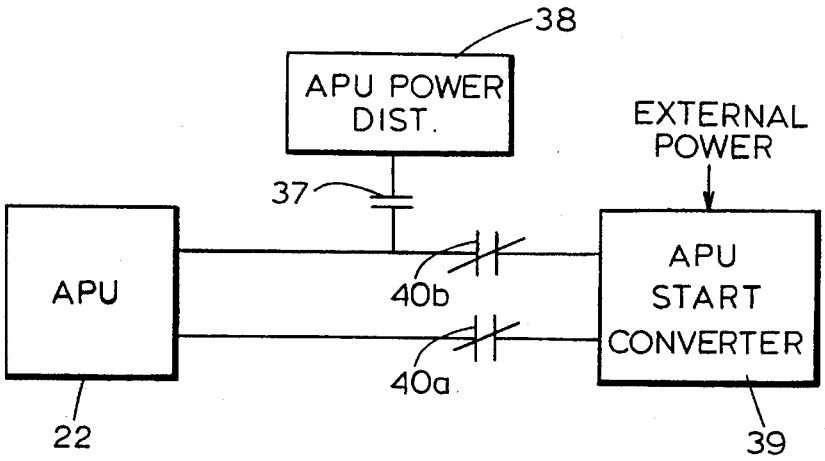
FIG. 1B

MAIN GENERATOR
POSITION SENSOR
PRIME MOVER
MAIN INVERTER
INVERSE TRANSFORMATION CIRCUIT
PHASE VOLTAGE TRANSFORMATION CIRCUIT
PHASE CURRENT TRANSFORMATION CIRCUIT
OSCILLATOR
SPEED PROCESSOR
10
16
18
18
42
44
50
52a-c
46
48
60
62
64
66
70
72
74
76
80
82
84
86
90
92
94
96
100
41
W*
W
$I_q^*$
$I_q$
$V_q^*$
$V_q$
$V_d^*$
$V_d$
$I_d$
$I_d^*$
$V_a^*$
$V_b^*$
$V_c^*$
$V_a$
$V_b$
$V_c$
$I_a$
$I_b$
$I_c$

METHOD AND APPARATUS FOR STARTING A SYNCHRONOUS MACHINE

TECHNICAL FIELD

The present invention relates to a method and apparatus for starting a synchronous machine.

BACKGROUND ART

An auxiliary power unit (APU) system is often provided on an aircraft and is operable to provide auxiliary and/or emergency power to one or more aircraft loads. In conventional APU systems, a dedicated starter motor is operated during a starting sequence to bring a gas turbine engine up to self-sustaining speed, following which the engine is accelerated to operating speed. Once this condition is reached, a brushless, synchronous generator is coupled to and driven by the gas turbine engine during operation in a starting mode whereupon the generator develops electrical power.

As is known, an electromagnetic machine may be operated as a motor to convert electrical power into motive power. Thus, in those applications where a source of motive power is required for engine starting, such as in an APU system, it is possible to dispense with the need for the dedicated starter motor and operate the generator as a motor during the starting sequence to accelerate the engine to self-sustaining speed. This capability is particularly advantageous in aircraft applications where size and weight must be held to a minimum.

The use of a generator in starting and generating modes in an aircraft application has been realized in a variable-speed, constant-frequency (VSCF) power generating system. In such a system a brushless, three-phase synchronous generator operates in the generating mode to convert variable-speed motive power supplied by a prime mover into variable-frequency AC power. The variable-frequency power is rectified and provided over a DC link to a controllable static inverter. The inverter is operated to produce constant-frequency AC power, which is then supplied over a load bus to one or more loads.

The generator of such a VSCF system is operated as a motor in the starting mode to convert electrical power supplied by an external AC power source into motive power which is provided to the prime mover to bring it up to self-sustaining speed. In the case of a brushless, synchronous generator including a permanent magnet generator (PMG), an exciter portion and a main generator portion mounted on a common shaft, it has been known to provide power at a controlled voltage and frequency to the armature windings of the main generator portion and to provide field current to the main generator portion field windings via the exciter portion so that the motive power may be developed. This has been accomplished in the past, for example, using two separate inverters, one to provide power to the main generator portion armature windings and the other to provide power to the exciter portion. Thereafter, operation in the generating mode may commence whereupon DC power is provided to the exciter field winding.

The use of single-phase AC excitation during operation in the starting mode can create problems due to the low power transfer capability across the exciter air gap. In order to provide sufficient main generator field current, a high AC voltage may be applied to the exciter field winding; however, application of such high AC voltage may create potential corona problems.

In order to improve the operation of a generator in the starting mode, the exciter portion of the generator may be modified, such as in U.S. Pat. No. 4,093,869 to Hoffman, et al.; however, modification of the exciter portion has disadvantages, and the need to modify the exciter portion precludes applicability of that concept to preexisting generators having standard exciter portions.

Lafuze, U.S. Pat. No. 3,902,073 and Stacey, U.S. Pat. No. 5,140,245 disclose starting systems for electromagnetic machines. Other systems for operating a brushless generator in a starting mode of operation are disclosed in Dhyanchand, U.S. Pat. No. 4,939,441, Dhyanchand, U.S. Pat. No. 5,013,929 and Glennon, et al., U.S. Pat. No. 5,068,590, all assigned to the assignee of the instant application.

SUMMARY OF THE INVENTION

The present invention relates to an apparatus and method for improving the starting performance of a synchronous generator having a main generator portion with an armature winding and a field winding rotatable with respect to the armature winding.

In the method, a parameter of power applied to the main generator portion armature winding is converted to sensed direct and quadrature power components, and the sensed direct and quadrature power components are compared with desired direct and quadrature power components to generate direct and quadrature power commands. To accelerate the synchronous generator, power is alternately applied to the main generator portion armature winding based upon the direct power command during a first series of time intervals and based upon the quadrature power command during a second series of time intervals which are exclusive of the first series of time intervals.

The sensed parameter of power from which the sensed direct and quadrature components are generated may be current or voltage. Alternatively, direct and quadrature components may be generated from both the current and voltage provided to the main generator portion armature winding.

A synchronous generator in connection with which the method is used includes a main generator portion having an armature winding and a field winding rotatable with respect to the armature winding and an inverter for providing power to the main generator portion armature winding.

The synchronous generator has a first transformation circuit for generating direct and quadrature components from a sensed parameter of power provided to the main generator portion armature winding and generating means for alternately generating a direct power command and a quadrature power command based upon the direct and quadrature components generated by the first transformation circuit. The direct and quadrature power commands are alternately generated during a number of mutually exclusive time periods.

The generator includes a second transformation circuit for converting the direct and quadrature power commands into three phase signals which are used by the inverter to apply excitation to the main generator portion armature winding to accelerate that winding with respect to the main generator portion field winding.

The generating means may comprise first means for comparing the direct component with a desired direct component and second means for comparing the quadrature component with a desired quadrature component. The generating means may also include a first switch that repeatedly provides the desired direct component to the first comparing means during a first series of time intervals and a second switch that repeatedly provides the desired quadrature component to the second comparing means during a second series of time intervals exclusive of the first series of time intervals.

BRIEF DESCRIPTION OF THE DRAWINGS

FIG. 1A comprises a combined block and schematic diagram of a brushless, synchronous generator;

FIG. 1B comprises a block diagram of an APU system together with a start converter;

DESCRIPTION OF THE PREFERRED EMBODIMENT

Figure 2:
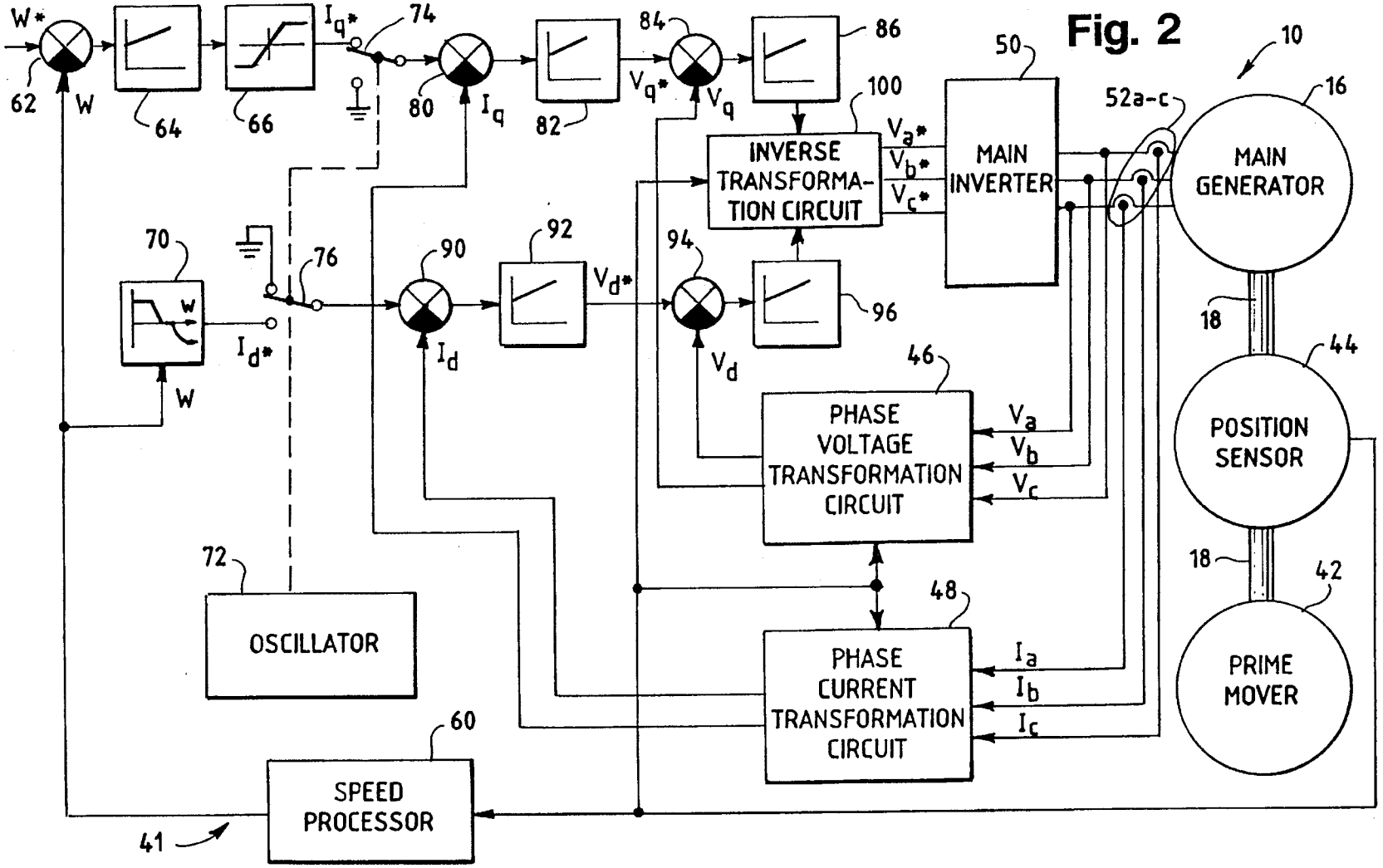
FIG. 2 comprises a block diagram of a preferred embodiment of the present invention.

Referring now to FIG. 1A, a brushless, synchronous generator 10 includes a permanent magnet generator (PMG) 12, an exciter portion 14 and a main generator portion 16. The generator 10 further includes a motive power shaft 18 interconnecting a rotor 20 of the generator 10 and a prime mover 21, such as a gas turbine engine. In a specific application of the present invention, the generator 10 and the prime mover 21 together may comprise an aircraft auxiliary power unit (APU) 22, although the present invention is equally useful in other prime mover/generator applications.

The rotor 20 carries one or more permanent magnets 23 which form poles for the PMG 12. Rotation of the motive power shaft 18 causes relative movement between the magnetic flux produced by the permanent magnet 23 and a set of three-phase PMG armature windings including phase windings 24*a*–24*c* mounted within a stator 26 of the generator 10.

The exciter portion 14 includes a field winding 28 disposed in the stator 26 and a set of three-phase armature windings 30*a*–30*c* disposed on the rotor 20. A set of rotating rectifiers 32 interconnect the exciter armature windings 30*a*–30*c* and a main generator portion field winding 34 also disposed on the rotor 20. Three-phase main generator portion armature windings 36*a*–36*c* are disposed in the stator 26.

During operation in a generating mode, at least one, and preferably all three of the PMG armature windings 24*a*–24*c* are coupled through a rectifier and voltage regulator (not shown) to the exciter portion field winding 28. As the motive power shaft 18 is rotated, power produced in the PMG armature windings 24*a*–24*c* is rectified, regulated and delivered to the field winding 28. AC power is produced in the armature windings 30*a*–30*c*, rectified by the rotating rectifiers 32 and applied to the main generator portion field winding 34. Rotation of the motive power shaft 18 and the field winding 34 induces three-phase AC voltages in the main generator portion armature windings 36*a*–36*c* as is conventional. As seen in FIG. 1B, the AC voltages are supplied through a contactor set 37 to an APU power distribution network 38 and thence to one or more loads (not shown).

Often, it is desirable to use the brushless generator 10 as a motor to bring the prime mover 21 up to self-sustaining speed. This operation is accomplished by providing electrical AC power to the main generator portion armature windings 36*a*–36*c* and suitably commutating the currents flowing in the windings 36*a*–36*c* to cause the motive power shaft 18 to rotate. In a specific embodiment, the electrical power for the generator 10 is developed by an APU start converter 39 which receives external electrical power and which is connected by contactor sets 40*a*, 40*b* to the exciter field winding 28 and the armature windings 36*a*–36*c*, respectively. Various methods have been devised for controlling the power supplied to the armature windings 36*a*–36*c* other than those described herein. Such other methods could be used in place of those described herein to accomplish the desired results, as should be evident to one of ordinary skill in the art, without departing from the spirit and scope of the present invention.

FIG. 2 illustrates a preferred embodiment of the present invention, which includes the main generator portion 16 coupled to a prime mover 42 via the motive power shaft 18 and a starting system control 41 for operating the generator 10 in a starting mode to convert electrical power into motive power for starting the prime mover 42.

The starting system control 41 includes a rotor position sensor 44 which develops a signal representing the angular position of the motive power shaft 18. The particular manner in which the rotor position signal is generated is not considered to be a feature of the present invention.

The rotor position sensor 44 is coupled to a phase voltage transformation circuit 46 and a phase current transformation circuit 48. The voltage transformation circuit 46 is responsive to phase voltages $V_a$, $V_b$ and $V_c$ developed by a pulse-width modulated (PWM) main inverter 50 and generates the direct and quadrature voltage components, $V_d$ and $V_q$, respectively, of the voltage generated by the inverter 50, based upon the angular position signal generated by the position sensor 44.

The inverter 50 may be of conventional design including six power switches and six associated flyback diodes connected in a conventional three-phase bridge configuration.

The phase current transformation circuit 48 is responsive to signals $I_a$, $I_b$ and $I_c$ representing the magnitudes of phase currents developed by the main inverter 50, as detected by current sensors 52*a*–52*c*, and generates the direct and quadrature current components, $I_d$ and $I_q$, respectively, of the current generated by the inverter 50, based upon the angular position signal generated by the position sensor 44. The transformation circuits 46, 48 are conventional and are based upon Park's transformation, which is also referred to as the dq0 transformation.

The angular position signal generated by the position sensor 44 is also supplied to a speed processor 60 which generates in a conventional manner a speed signal $\omega$ representing the sensed speed of rotation of the rotor 20. The speed signal generated by the speed processor 60 is compared with a speed command $\omega^*$, which represents the desired speed at any point in time, by a summer 62. The difference between the sensed and desired speed as determined by the summer 62 is provided as an error signal to a proportional-integral gain and compensation unit 64. The output of the gain and compensation unit 64 is limited by a limiter 66, which generates a quadrature current command, $I_q^*$, representing the desired quadrature current.

The output of the speed processor 60 is also provided to a function generator 70 which generates a direct current command, $I_d^*$, based upon the speed signal generated by the speed processor 60. At zero and relatively low speeds, as determined by the signal generated by the speed processor 60, the function generator 70 outputs a direct current command having a maximum positive value. At intermediate speeds when excitation is supplied by applying DC power to the exciter field winding 28, the function generator 70 outputs a direct current command which is zero in order to provide a near maximum torque-to-current ratio, and at higher speeds, the function generator 70 outputs a negative direct current command to provide phase advance in coordination with the weakening of the DC exciter field.

The above manner in which the magnitude of the direct current command $I_d$*, is controlled assumes that DC excitation is provided to the exciter field winding 28 during the starting mode. If DC excitation is not provided to the exciter field winding 28 during operation in this, the magnitude of the direct current command $I_d$* should be maintained at a constant level, instead of changing in magnitude as described above. Other variations in the manner in which the function generator 70 generates the direct current control command may be utilized.

At any given time during startup of the generator 10, the main generator portion 16 is alternately excited with purely direct current and purely quadrature current. The direct current builds the field in the main generator portion 16, whereas the quadrature current, which is applied before the field substantially decays, generates torque on the rotor 20.

The alternate direct and quadrature excitation provided to the main generator portion 16 is controlled by an oscillator 72 connected to a pair of switches 74, 76. The switch 74 selectively provides the quadrature current command $I_q$*, to a summer 80, and the switch 76 selectively provides the direct current command $I_d$*, to a summer 90.

The switches 74, 76 are simultaneously switched, and at any given time, one of the switches 74, 76 is connected to ground, and the other of the switches 74, 76 is connected to receive its respective command signal, $I_q$*, or $I_d$*. As a result, the main generator portion 16 is excited with either purely direct excitation or purely quadrature excitation.

The frequency and duty cycle of the oscillator 72, which determine at what rate the switches 74, 76 are switched and how long they remain in their two positions, respectively, may be selected based on the time constant of the main generator portion 16 so that the field generated within the main generator portion 16 (via connection of switch 74 to its command signal $I_q$*) does not significantly decay during the starting mode.

For example, the oscillator 72 may have a fixed frequency of five hertz and a duty cycle of 50% throughout the starting mode of operation so that each of the switches 74, 76 is alternately provided in one position for 100 milliseconds and in the other position for 100 milliseconds. Other frequencies and duty cycles may be utilized.

The summer 80 which periodically receives the quadrature current command $I_q$* also receives the sensed quadrature current signal $I_q$ from the phase current transformer circuit 48. The summer 80 generates an error signal, representing the difference between the two signals, which is processed by a proportional-integral gain and compensation unit 82 to produce a quadrature voltage command $V_q$*. That command signal is provided to a summer 84 along with the quadrature voltage signal $V_q$ generated by the voltage transformation circuit 46. The difference between the signals as determined by the summer 84 is provided to a proportional-integral gain and compensation unit 86.

The summer 90 which periodically receives the direct current command $I_d$* also receives the sensed direct current signal $I_d$ from the phase current transformer circuit 48. The summer 90 generates an error signal, representing the difference between the two signals, which is processed by a proportional-integral gain and compensation unit 92 to produce a direct voltage command $V_d$*. That command signal is provided to a summer 94 along with the direct voltage signal $V_d$ generated by the voltage transformation circuit 46. The difference between the signals as determined by the summer 94 is provided to a proportional-integral gain and compensation unit 96.

The outputs of both the units 86 and 96, representing the desired quadrature and direct phase voltages, respectively, are provided to an inverse transformation circuit 100, which converts such signals into three voltage command signals $V_a$*, $V_b$*, and $V_c$* in a conventional manner.

The three voltage commands are provided to the main inverter 50, which is of the three-phase type including six controllable power switches and six flyback diodes connected in a conventional bridge configuration, which is connected to drive the main generator portion armature windings 36.

The generator 10 may be operated in a generating mode, during which PMG armature windings **24*a*–24*c* are coupled through a rectifier and voltage regulator (not shown) to the exciter portion field winding 28. As the motive power shaft 18 is rotated, power produced in the PMG armature windings 24*a*–24*c* is rectified, regulated and delivered to the field winding 28. AC power is produced in the armature windings 30*a*–30*c*, rectified by the rotating rectifiers 32 and applied to the main generator portion field winding 34. Rotation of the motive power shaft 18 and the field winding 34 induces three-phase AC voltages in the main generator portion armature windings 36*a*–36*c*** as is conventional.

When the generator 10 is operated in the starting mode, purely direct excitation and purely quadrature excitation are alternately provided to the main generator portion armature windings 36. The direct excitation maintains the field in the main generator portion 16 by applying direct current to the armature windings 36, and the quadrature excitation provides torque by applying quadrature current to the armature windings 36.

Various methods have been devised for supplying power to the main generator field winding 34 via the exciter 14 during the starting mode. However, depending upon the physical characteristics of the generator being started, it may not be necessary to supply power to the exciter 14. If power is to be supplied to the exciter 14 via the field winding 28 during operation in the starting mode, rather than DC power, it may instead comprise AC power at 400 Hz with a peak-to-peak voltage of 400 volts. The power may be supplied from a power source other than the main inverter 50, or it may be generated based on one or more signals generated by the main inverter 50.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A method of starting a synchronous generator having a main generator portion with an armature winding and a field winding rotatable with respect to said armature winding and an exciter portion with a field winding and an armature winding rotatable with respect to said field winding, said method comprising the steps of:

(a) converting a parameter of power applied to the main generator portion armature winding to generate sensed direct and quadrature power components;

(b) comparing said sensed direct and quadrature power components with desired direct and quadrature power components to generate direct and quadrature power commands;

(c) applying power to said main generator portion armature winding based upon said direct power command during a first period of time;

(d) applying power to said main generator portion armature winding based upon said quadrature power command during a second period of time exclusive of said first period of time; and (e) repeating said steps (c) and (d) a plurality of times in order to accelerate said synchronous generator to a threshold speed.

2. A method as defined in claim 1 wherein said parameter of power of said step (a) is voltage.

3. A method as defined in claim 1 wherein said parameter of power of said step (a) is current.

4. A method as defined in claim 1 wherein said direct and quadrature power commands of said step (b) are voltage commands.

5. A method as defined in claim 1 wherein said steps (c) through (d) are performed without providing any power to said exciter field winding.

6. A method of starting a synchronous generator having a main generator portion with an armature winding and a field winding rotatable with respect to said armature winding and an exciter portion with a field winding and an armature winding rotatable with respect to said field winding, said method comprising the steps of:

(a) sensing the voltage applied to said main generator portion armature winding and converting said sensed voltage to sensed direct and quadrature voltage components;

(b) sensing the current provided to said main generator portion armature winding and converting said sensed current to sensed direct and quadrature current components;

(c) comparing said sensed direct and quadrature current components with desired direct and quadrature current components to generate desired direct and quadrature voltage components;

(d) comparing said sensed direct and quadrature voltage components with said desired direct and quadrature voltage components to generate direct and quadrature voltage commands;

(e) applying power to said main generator portion armature winding based upon said direct voltage command during a first period of time;

(f) applying power to said main generator portion armature winding based upon said quadrature voltage command during a second period of time exclusive of said first period of time; and (g) repeating said steps (e) and (f) a plurality of times in order to accelerate said synchronous generator to a threshold speed.

7. A synchronous generator, comprising:

a main generator portion having an armature winding and a field winding rotatable with respect to said armature winding;

an inverter coupled to said main generator portion armature windings for providing power to said main generator portion armature winding during a starting mode;

means coupled to said inverter for sensing a parameter of said power provided by said inverter to said main generator portion armature winding during said starting mode;

a first transformation circuit for generating direct and quadrature components from said sensed parameter of power;

generating means for alternately generating a direct power command and a quadrature power command based upon said direct and quadrature components generated by said first transformation circuit, said direct and quadrature power commands being alternately generated during a number of mutually exclusive time periods; and a second transformation circuit responsive to said generating means for converting said direct power command and said quadrature power command into three phase signals, said three phase signals being used by said inverter to apply excitation to said main generator portion armature winding to accelerate said main generator portion armature winding wight respect to said main generator portion field winding.

8. A synchronous generator as defined in claim 7 wherein said generating means comprises:

first means for comparing said direct component with a desired direct component; and second means for comparing said quadrature component with a desired quadrature component.

9. A synchronous generator as defined in claim 8 wherein said generating means additionally comprises:

a first switch coupled to said first comparing means that repeatedly provides said desired direct component to said first comparing means during a first series of time intervals; and a second switch coupled to said second comparing means that repeatedly provides said desired quadrature component to said second comparing means during a second series of time intervals exclusive of said first series of time intervals.

10. A generator as defined in claim 8 wherein each of said first and second comparing means comprises a summer.

11. A control for operating a brushless generator in a starting mode of operation wherein the generator has a main generator portion including an armature winding disposed in a stator and a field winding disposed on a rotor movable with respect to the stator and an exciter having an exciter field winding disposed in the stator and an armature winding disposed on the rotor and coupled to the main generator portion field winding wherein the main generator portion armature winding is capable of receiving electrical power from a controllable power source during the starting mode of operation, comprising:

a converter responsive to a parameter of power provided to the main generator portion armature winding for converting the detected parameter magnitude into field and torque producing components;

means for alternately providing field and torque commands; and means responsive to said field and torque producing components and said field and torque commands for controlling said power source during operation in the starting mode such that the rotor is rotated.

* * * * *